US007955161B2

(12) United States Patent
Eyler

(10) Patent No.: US 7,955,161 B2
(45) Date of Patent: Jun. 7, 2011

(54) HANDHELD SANDER

(76) Inventor: Ronald E. Eyler, Hagerstown, MD (US)

( * ) Notice: Subject to any disclaimer, the term of this patent is extended or adjusted under 35 U.S.C. 154(b) by 434 days.

(21) Appl. No.: 12/222,311

(22) Filed: Aug. 7, 2008

(65) Prior Publication Data

US 2010/0035528 A1 Feb. 11, 2010

(51) Int. Cl.
*B24B 23/02* (2006.01)

(52) U.S. Cl. ..... 451/358; 451/360; 451/524; 451/525

(58) Field of Classification Search ..... 30/514, 30/517; 451/342, 344, 354, 358, 360, 523, 451/524, 525

See application file for complete search history.

(56) References Cited

U.S. PATENT DOCUMENTS

| | | | | |
|---|---|---|---|---|
| 1,831,554 | A | 11/1931 | Domres | |
| 1,936,449 | A | 11/1933 | De Marchi | |
| 1,959,307 | A * | 5/1934 | Wilhelm | 15/23 |
| 2,773,337 | A | 12/1956 | De Marchi | |
| 2,853,838 | A * | 9/1958 | Richards | 451/358 |
| 2,866,212 | A * | 12/1958 | William et al. | 15/88 |
| 3,137,106 | A | 6/1964 | Griffith, Jr. | |
| 3,172,138 | A | 3/1965 | Price | |
| 3,648,413 | A | 3/1972 | Godwin et al. | |
| 3,793,782 | A | 2/1974 | Bowling | |
| 3,858,368 | A * | 1/1975 | Cocherell et al. | 451/490 |
| D262,670 | S * | 1/1982 | Wellin | D4/102 |
| 4,780,992 | A | 11/1988 | McKervey | |
| 5,239,783 | A * | 8/1993 | Matechuk | 451/354 |
| 5,336,330 | A | 8/1994 | Shumway et al. | |
| 5,662,515 | A | 9/1997 | Evensen | |
| 5,921,854 | A | 7/1999 | Evensen | |
| 5,967,887 | A | 10/1999 | Synowski | |
| 6,041,463 | A | 3/2000 | Stauch | |
| 6,817,932 | B2 | 11/2004 | Furey | |
| 7,022,003 | B1 | 4/2006 | Hughes | |
| 7,048,617 | B1 | 5/2006 | Spiva | |
| 2008/0060149 | A1 * | 3/2008 | Wu et al. | 15/29 |

* cited by examiner

*Primary Examiner* — Timothy V Eley
(74) *Attorney, Agent, or Firm* — Stephen R. Greiner

(57) ABSTRACT

A handheld sander having an abrasive roller and a flexible drive shaft that is connected at the outer end thereof to the roller and is connected at the inner end thereof to an electric motor. A handle encloses the motor. An extension arm extends from the handle and encloses the drive shaft.

4 Claims, 1 Drawing Sheet

HANDHELD SANDER

FIELD OF THE INVENTION

The present invention relates generally to portable abrading tools and, more particularly, to such tools with rotary cylinders.

BACKGROUND OF THE INVENTION

Drywall is a manufactured building material used for constructing walls and ceilings within buildings. In commercial construction, the work of installing and finishing drywall is often split between: "hangers" who secure drywall sheets to wall studs or ceiling joists, "tapers" who conceal the joints between drywall sheets with joint tape, and "mudmen" who hide the joint tape and any nailheads with several layers of joint compound which is often called "mud." After applying the joint compound, it is allowed to air dry and, then, sanded smooth in preparation for painting.

Applying joint compound to drywall is a straightforward effort with a trowel, usually taking a few coats. In new construction, joint compound effectively eliminates all blemishes from the surface of the drywall. Joint compound can also be used to finish corner bead and trim as well as patch holes, bumps, tears, and other minor drywall damage.

Drywall is installed in an average home in a few days by a crew of experienced workers. Larger houses, and those where optimum finishes are desired, take more time and cost more. For an optimum finish, entire walls may be given "skim coats" or thin layers of joint compound. Sanding performed after each of the skim coats yields near-perfect wall surfaces. Since sanding is difficult, time-consuming, and expensive, mudmen and their employers are constantly looking for new ways to make drywall finishing easier to perform.

SUMMARY OF THE INVENTION

In light of the problems associated with the known tools and methods associated with finishing drywall, it is a principal object of the invention to provide a handheld sander that can operate in hard-to-reach areas so as to make the smoothing of drywall surfaces quick and easy.

It is an object of the invention to provide improved features and arrangements thereof in a handheld sander for the purposes described which is lightweight in construction, inexpensive to manufacture, and dependable in use.

Briefly, the sander made in accordance with this invention achieves the intended objects by featuring an abrasive roller. A flexible drive shaft is connected at its outer end to the abrasive roller. The inner end of the drive shaft carries a drive dog. An electric motor is connected to the inner end of the drive shaft. The electric motor has a drive hub that is rotated when the motor is energized, and the hub has a socket for releasably receiving the drive dog. A handle encloses the motor. An extension arm is releasably connected at its inner end to the handle and extends outwardly from the handle to the roller. The extension arm encloses the drive shaft.

The foregoing and other objects, features, and advantages of the present invention will become readily apparent upon further review of the following detailed description of the handheld sander as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
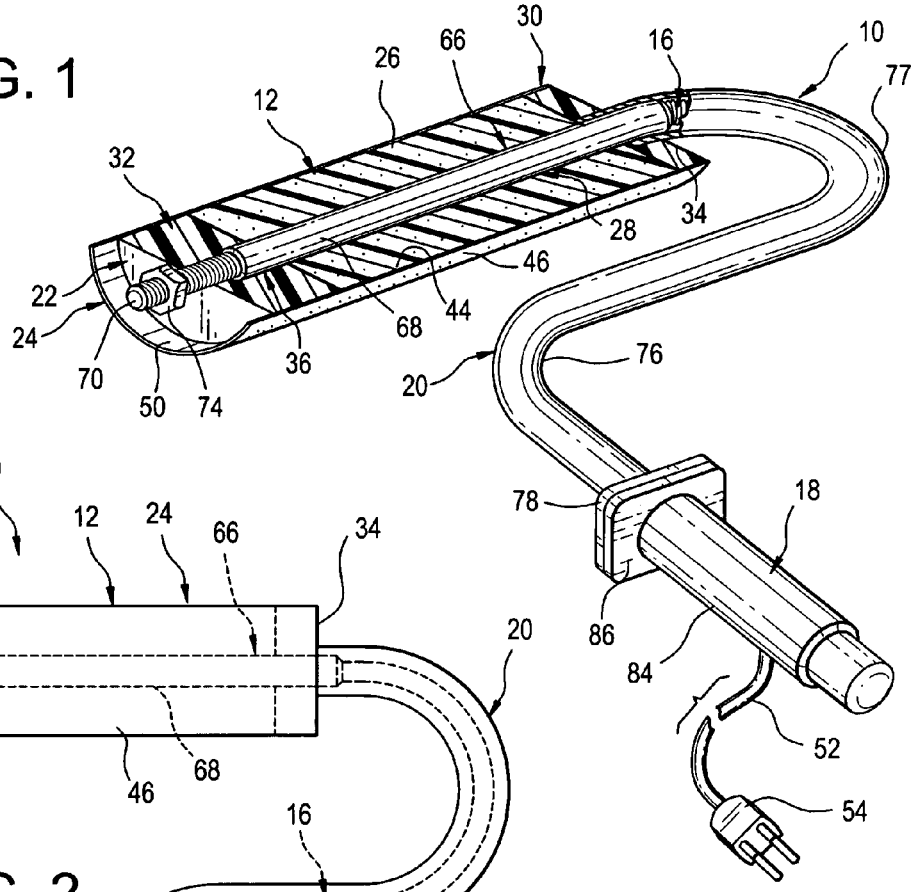
FIG. 1 is a perspective view of a handheld sander in accordance with the present invention with portions broken away to reveal details thereof.
Figure 1:
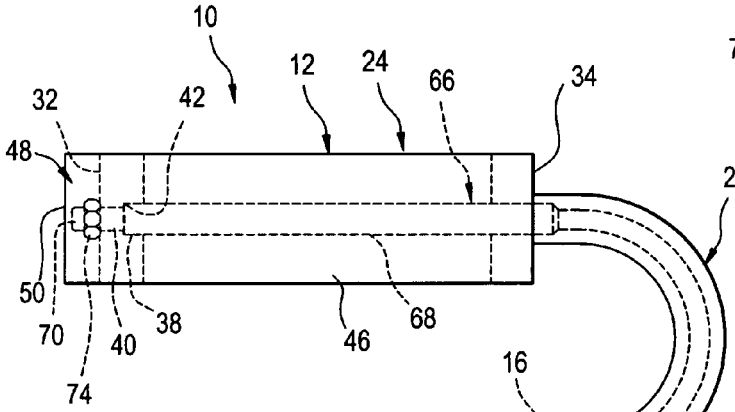

Referring now to the FIGS., a handheld sander in accordance with the present invention is shown at 10. Sander 10 includes an abrasive roller 12 that is connected to an electric motor 14 by a flexible drive shaft 16. A handle 18 covers motor 14. An extension arm 20 extends from handle 18 to roller 12 and encloses drive shaft 16.

Roller 12 includes a core 22 over which a sanding sleeve 24 is fitted. Core 22 has a hollow, foam rubber cylinder 26 with a longitudinal bore 28 that extends from one end of cylinder 26 to the other. An inner end cap 30 is affixed to the inner end of cylinder 26 and an outer end cap 32 is affixed to the outer end of the cylinder 26.

Inner end cap 30 is a plastic disk with a hole 34 at its center. The outer diameter of cap 30 is the same as that of cylinder 26. Hole 34 is axially aligned with longitudinal bore 28 and has the same diameter as longitudinal bore 28.

Outer end cap 32 is a plastic disk with a hole 36 at the center thereof. The outer diameter of cap 32 is the same as that of cylinder 26 and end cap 30. Hole 36 is axially aligned with longitudinal bore 28 and hole 34 and has an inner segment 38 with the same diameter as that of longitudinal bore 28 and hole 34 and an outer segment 40 of reduced diameter. Thus, a shoulder 42 is formed at the junction of segments 38 and 40.

Sanding sleeve 24 comprises a paper or cardboard tube 44 having an abrasive coating 46 applied to the exterior surface thereof. As shown, tube 44 has a longitudinal passageway 48 with a diameter that permits sleeve 24 to be snugly, yet slidably, fitted upon core 22. Tube 44 also has a length sufficient to not only cover core 22 but to project a short distance outwardly from the outer end of core 22 to form an outwardly projecting, circumferential lip 50.

Coating 46 is any abrasive, granular material capable of grinding or abrading. This material can be a natural one such as silica, diamond or corundum. Alternatively, the material can be synthetic like silicon carbide.

Electric motor 14 is compact in size, capable of fitting in the palm of a hand of a user. Motor 14 is energized by connecting a cable 52 that extends from motor 14 to an electrical current source like a wall outlet. A plug 54 connected to the free end of cable 52 facilitates connection to a wall outlet.

Motor 14 has a drive hub 56 that is rotated at high speed when motor 14 is energized. Hub 56 is cylindrical and is provided with a socket 58 of polygonal outline at its center. Although socket 58 is shown to have a square outline, it can have any desired number of sides.

Drive shaft 16 comprises a flexible metallic rod 60 wound with wire so as to form a flexible metallic casing 62. Casing 62 reduces wear to enclosed rod 60 and controls bending of rod 60 by guiding rod 60 into gradual bends. Drive shaft 16 can be provided with any suitable length.

The inner end of rod 60 is provided with a drive dog 64 adapted for snug, yet releasable, insertion into socket 58 of hub 56. To this end, drive dog 64 is provided with a polygonal cross section having a shape that corresponds with that of socket 58, i.e., a square cross section. Like socket 58, however, dog 64 can be provided with other suitable polygonal configurations.

A roller retainer 66 is affixed to the outer end of rod 60. Retainer 66 comprises a dowel 68 formed of a stiff metallic alloy. As illustrated, dowel 68 has a length adequate to extend from the outer end of extension arm 20, through cylinder 26, to shoulder 42 in end cap 32. Dowel 68 has a diameter that permits snug, yet slidable, positioning in longitudinal bore 28 and inner segment 38 of hole 36.

A pin 70 is affixed to, and extends outwardly from, the outer end of dowel 68. Pin 70 has a length sufficient to extend through outer segment 40 of hole 36 and outwardly from end cap 32 when dowel 68 is seated against shoulder 42. Furthermore, pin 70 has a diameter adequate for a snug, yet slidable, fit in outer segment 40 of hole 36.

Pin 70 has external, helical threads 72 along the length thereof for threadably receiving a nut 74. Tightening nut 74 holds the outer end of dowel 68 against shoulder 42 and locks roller 12 onto the balance of sander 10.

Figure 2:
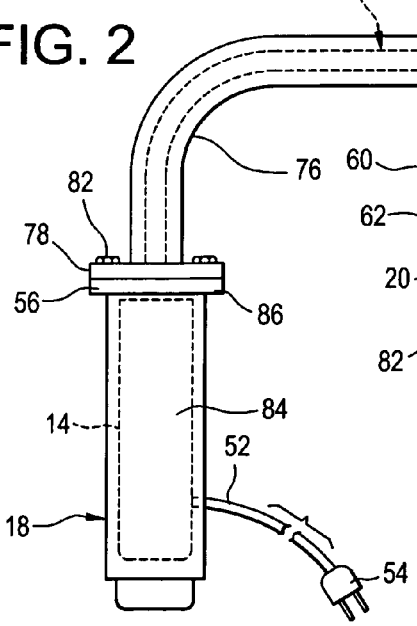
FIG. 2 is a top view of the sander of FIG. 1.
Figure 3:
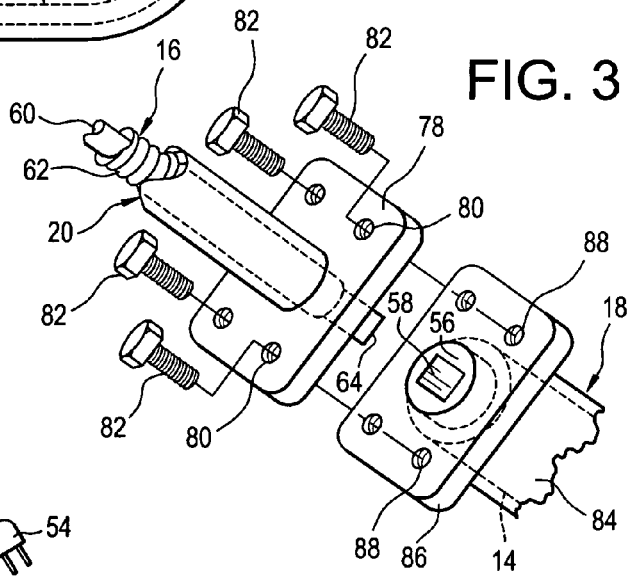
FIG. 3 is a perspective view of the drive shaft connection assembly of the sander.

Drive shaft 16 extends through extension arm 20 that supports roller 12 at a right angle to handle 18. Arm 20 has a sinuous shape with in inner bend 76 near handle 18 that turns drive shaft 16 nearly 90° to the right as seen in FIG. 2. Arm 20 has an outer bend 77 that gradually sweeps drive shaft 16 180° back to the left as seen in FIG. 2. Arm 20 can be provided with any suitable length, and it is expected that sander 10 will be sold in the form of a kit with arms 10 and associated drive shafts 16 having different lengths. Long arms 20 would be used for access to hard-to-reach areas whereas shorter arms 20 would be used for typical work.

A retaining collar 78 is affixed to the inner end of extension arm 20 for the releasable attachment of extension arm 20 to handle 18. Collar 78 is a flat, rectangular plate that is penetrated at its center by the inner end of arm 20. Each of the four corners of collar 78 is provided with a bore 80 through which a threaded fastener 82 can be extended.

Handle 18 is a durable, heat resistant tube 84 with a retaining band 86 affixed to the open, inner end thereof. Band 86 is a flat, rectangular plate that is penetrated at its center by hub 56 and tube 84. Each of the four corners of band 86 is provided with an internally threaded bore 88 into which a threaded fastener 82 passing through collar 78 can be screwed so as to attach arm 20 to handle 18. Cable 52 passes through tube 84 remote from band 86.

From the foregoing, it should be appreciated that the use of sander 10 is straightforward. Assuming roller 12 is in place at the end of drive shaft 16. A user need only energize motor 14 by inserting plug 54 into a wall outlet and, then, touch roller 12 to a surface in need of sanding. Sanding continues as long as is required.

In the event that sanding sleeve 24 becomes worn by the loss of abrasive coating 46 due to repeated use. A user need only deenergize motor 14 and pull the worn sleeve 24 outwardly from core 22 by applying a light force. Finally, a new sleeve 24, with an intact coating 46, is slid onto core 22 with care being taken to reestablish the circumferential lip 50 that prevents nut 74 from contacting a surface being worked by sander 10.

If a user needs to sand an area that is out-of-reach, he can replace arm 20 with one having a greater length and that spaces roller 12 farther from handle 18. First, fasteners 82 are removed from retaining collar 78 of arm 20 thereby detaching arm 20 from handle 18. Then, the drive dog in the longer arm (not shown) is inserted into socket 58 in hub 56. Next, fasteners 82 are extended through bores 80 in the collar 78 of the longer arm and into bores 88 in band .86 Finally, fasteners 82 are tightened to lock the longer arm upon handle 18. The entire process of swapping arms 20 requires only a few minutes to complete. Once accomplished, sander 10 is ready to use provided that roller 12. The sander with the longer arm can reach a great distance.

While sander 10 has been described with a high degree of particularity, it will be appreciated by those skilled in the art that modifications can be made to it. Therefore, it is to be understood that the present invention is not limited to merely to sander 10, but encompasses any and all sanders within the scope of the following claims.

I claim:

1. A handheld sander, comprising:

an abrasive roller;

a flexible drive shaft having a first inner end and a first outer end, said first outer end being connected to said abrasive roller, and said first inner end carrying a drive dog;

an electric motor being connected to said first inner end of said flexible drive shaft, said electric motor having a drive hub that is rotated when said motor is energized, said drive hub having a socket therein for releasably receiving said drive dog;

a handle enclosing said motor; and, an extension arm having a second inner end and a second outer end, said extension arm being connected at said second inner end to said handle and extending to said roller, and said extension arm enclosing said drive shaft.

2. The handheld sander according to claim 1 wherein said handle is provided with a plurality of internally threaded bores, and said handheld sander further comprising:

a retaining collar being affixed to said second inner end of said extension arm, said retaining collar being provided with a plurality of second bores spaced for registration with said internally threaded bores in said handle; and, a plurality of threaded fasteners passing through said second bores into said internally threaded bores for releasably connecting said extension arm to said handle.

3. The handheld sander according to claim 1 wherein said abrasive roller includes:

a core having a hole therein with an inner segment and an outer segment that abut one another, said inner segment having a first diameter and said outer segment having a second diameter that is less than said first diameter so as to form a shoulder at the abutment of said inner segment and said outer segment; and, a sanding sleeve slidably fitted over said core.

4. The handheld sander according to claim 3 wherein said flexible drive shaft carries a dowel at said first outer end thereof being sized for snug passage through said inner segment and for abutment with said shoulder in said core, and said drive shaft further carries an externally threaded pin being affixed to said dowel and being sized for snug passage through said outer segment so as to extend from said core; and wherein said sander further comprises a nut being threadably engaged with said pin for retaining said dowel in contact with said shoulder.

* * * * *